US010124615B2

(12) United States Patent
Matsumoto

(10) Patent No.: US 10,124,615 B2
(45) Date of Patent: Nov. 13, 2018

(54) PRINTING APPARATUS

(71) Applicant: CANON KABUSHIKI KAISHA, Tokyo (JP)

(72) Inventor: Toshiya Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/651,304

(22) Filed: Jul. 17, 2017

(65) Prior Publication Data

US 2018/0029393 A1 Feb. 1, 2018

(30) Foreign Application Priority Data

Jul. 29, 2016 (JP) ..... 2016-149978

(51) Int. Cl.

| | |
|---|---|
| ***B41J 25/00*** | (2006.01) |
| ***B41J 13/00*** | (2006.01) |
| ***B41J 13/10*** | (2006.01) |
| ***B65H 31/00*** | (2006.01) |

(52) U.S. Cl.

CPC ..... *B41J 25/006* (2013.01); *B41J 13/0036* (2013.01); *B41J 13/106* (2013.01); *B65H 31/00* (2013.01)

(58) Field of Classification Search

CPC .... B41J 25/006; B41J 25/001; B41J 25/3081; B41J 25/3086; B41J 25/304; B41J 25/308; B41J 11/008; B41J 13/0036; B41J 13/106

See application file for complete search history.

(56) References Cited

U.S. PATENT DOCUMENTS

2003/0048345 A1* 3/2003 Matsumoto ..... B41J 11/005 347/104

FOREIGN PATENT DOCUMENTS

| | | |
|---|---|---|
| JP | 2001072309 A | 3/2001 |
| JP | 2004216591 A | 8/2004 |
| JP | 2014015276 A | 1/2014 |
| JP | 2014031257 A | 2/2014 |

* cited by examiner

*Primary Examiner* — Juanita D Jackson

(74) *Attorney, Agent, or Firm* — Canon U.S.A., Inc. IP Division

(57) ABSTRACT

A printing apparatus includes a printing head that prints on a printing medium, a moving member that moves reciprocally with the printing head, and a conveying member that conveys the printing medium in a direction which intersects a printing head moving direction. Also included are a module contained in a contained position in a non-printing period, and developed in a developed position in a printing period, and a drive connection member that moves the module between the contained and developed positions with conveying member drive. The drive connection member includes a trigger arm that enters a printing head moving area when the moving member is driven in a direction opposite to which the printing medium is conveyed. When the moving member presses and moves the trigger arm, the conveying member is connected to the module such that a connected state in which the driving force transmission is maintained.

10 Claims, 10 Drawing Sheets

PRINTING APPARATUS

BACKGROUND OF THE INVENTION

Field of the Invention

The present disclosure relates to a printing apparatus.

Description of the Related Art

Hitherto, there is a printing apparatus in which an ejection tray is provided so as to be capable of being advanced and retracted with respect to a main body of a printing apparatus. When a printed printing medium (a sheet) is stacked on the ejection tray, the ejection tray is extended, and when the printing medium is not stacked (during a non-printing period, for example), the ejection tray is retracted. In a printing apparatus disclosed in Japanese Patent Laid-Open No. 2001-72309, driving force of a sheet conveying member is transmitted to an advancing and retracting mechanism of an ejection tray through a friction torque limiter. Through a sheet conveying operation during a printing period, when the ejection tray is extended and reaches a stack position, the friction torque limiter slides and the extending of the ejection tray is stopped. Furthermore, by driving the sheet conveying member in a direction opposite to the direction during the printing period, the ejection tray can be shortened and can be retracted to the contained position.

However, in the configuration described in Japanese Patent Laid-Open No. 2001-72309, the friction torque limiter and the advancing and retracting mechanism may become resistances in conveying the sheet since the sheet conveying member is connected at all times to the advancing and retracting mechanism of the ejection tray through the friction torque limiter; accordingly, there is a concern that the sheet conveyance accuracy during the printing period may decrease. Furthermore, during switchback conveyance for double-sided printing and the like, there is a concern that the ejection tray on which the printed sheet is stacked may be drawn into the apparatus body together with the sheet, causing sheet jamming.

Moreover, the driving force conveying the sheet may be used not only for the advancing and retracting operation of the ejection tray but also for the maintenance and the like of the printing head. However, with such a configuration, there is a concern that the ejection tray may be extended when the user does not intend the ejection tray to do so, and the ejection tray may be retreated with the sheet stacked thereon, dropping the stacked sheet.

SUMMARY OF THE INVENTION

The present disclosure provides a printing apparatus in which the conveyance accuracy of the printing medium is not reduced and the printing accuracy is not reduced, the operability is improved by controlling the advancement and retraction of the advancing and retracting module that can be contained during the non-printing period, and cost can be set low and space can be saved.

According to an aspect of the present invention, a printing apparatus includes a printing head that performs printing on a printing medium, a moving member that moves reciprocally with the printing head on the moving member, a conveying member that conveys the printing medium in a conveying direction which intersects a moving direction of the printing head, an advancing and retracting module that is contained in a contained position in a non-printing period, and that is developed in a developed position in a printing period, and a drive connection member that moves the advancing and retracting module between the contained position and the developed position with drive of the conveying member, wherein the drive connection member includes a trigger arm that enters a moving area of the printing head when the moving member is driven a predetermined amount in a direction opposite to a direction in which the printing medium is conveyed during the printing period, and wherein, in a state in which the moving member presses and moves the trigger arm that has entered the moving area of the printing head, the conveying member is connected to the advancing and retracting module such that a connected state in which transmission of the driving force is maintained.

Further features of the present invention will become apparent from the following description of embodiments with reference to the attached drawings.

DESCRIPTION OF THE EMBODIMENTS

Hereinafter, embodiments of the present disclosure will be described with reference to the drawings.

First Embodiment

Figure 1:
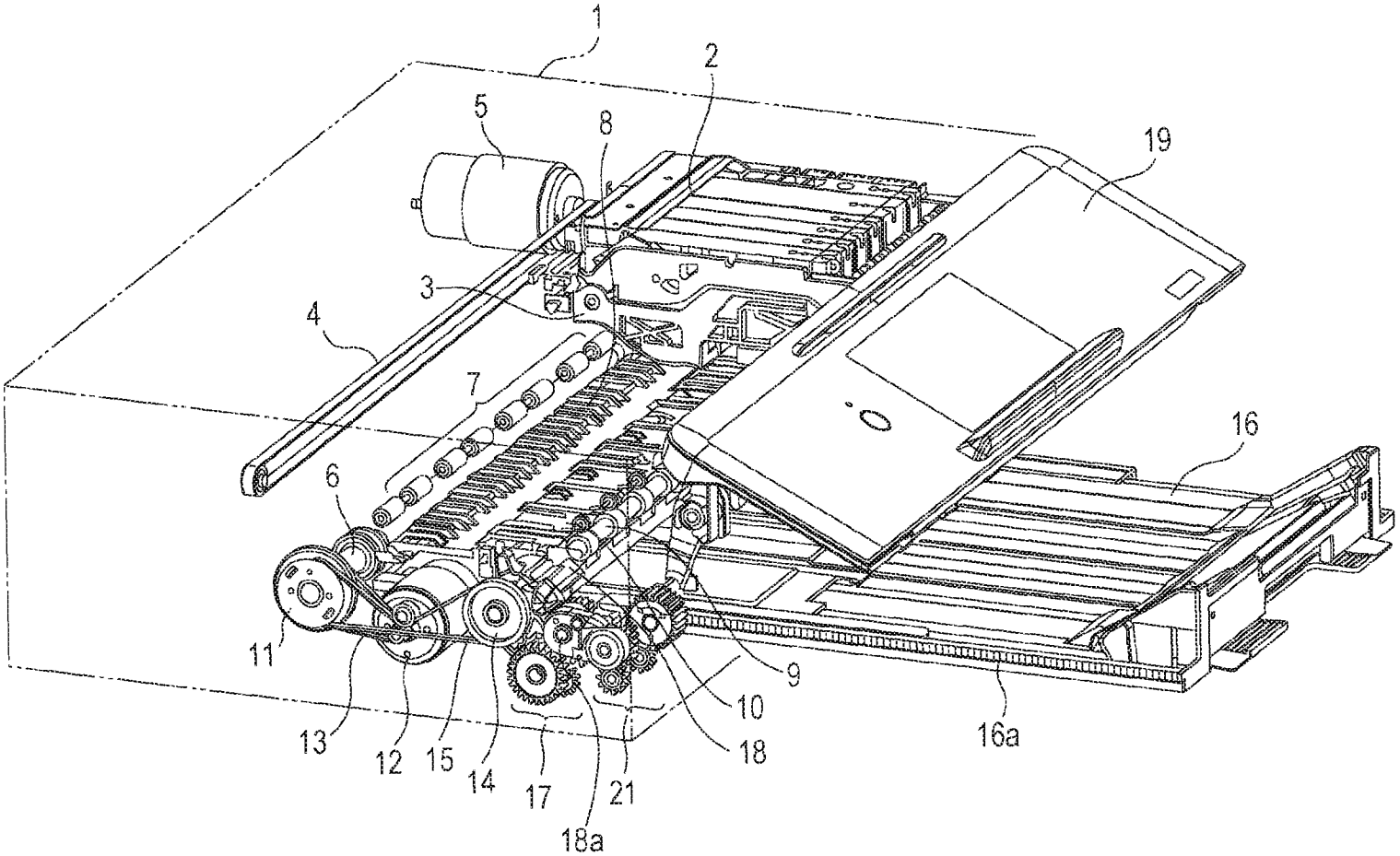
FIG. 1 is a printing apparatus of a first embodiment of the present disclosure viewed from the front left side.
Figure 2:
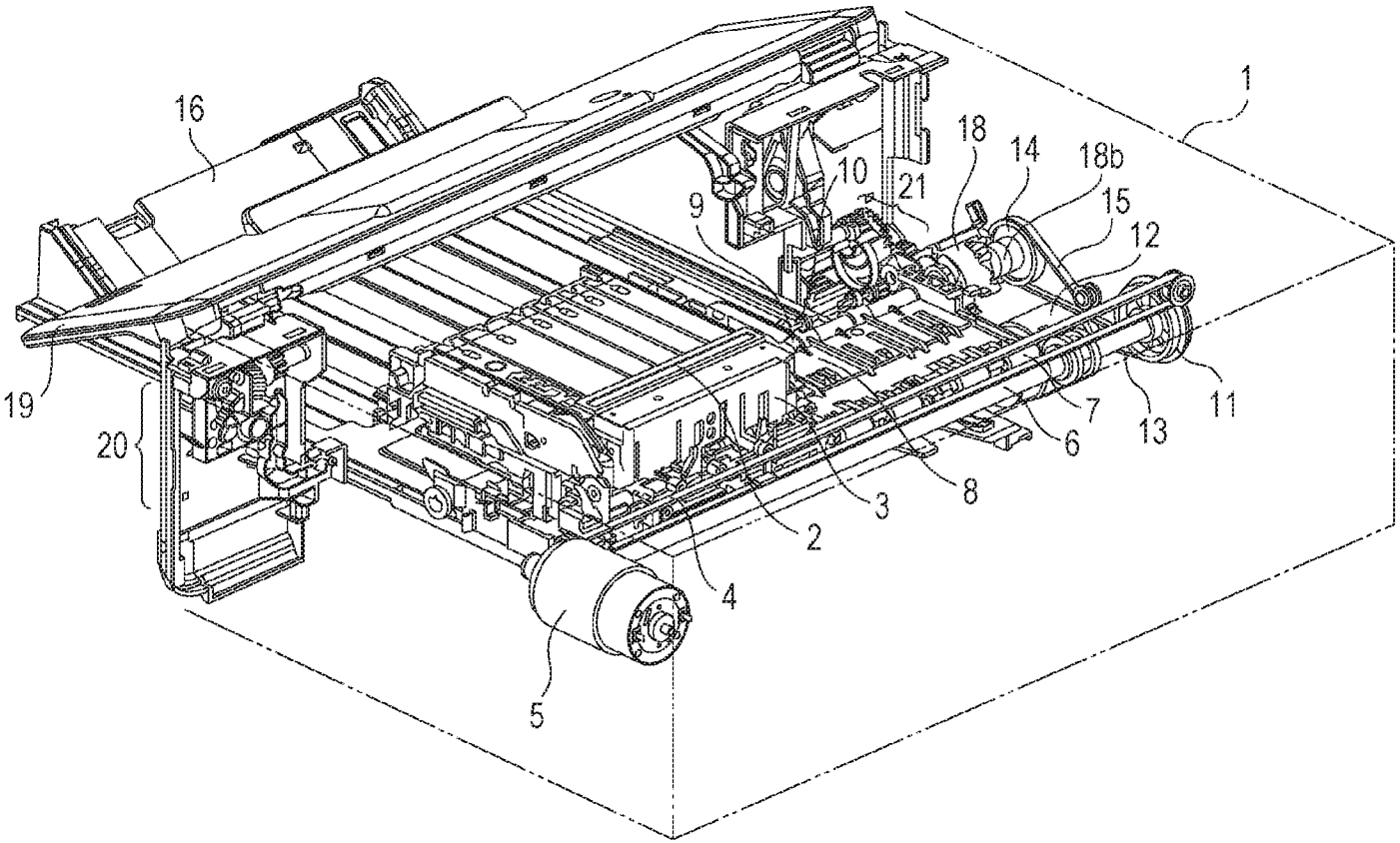
FIG. 2 is a perspective view of the printing apparatus illustrated in FIG. 1 viewed from the rear right side.
Figure 3:
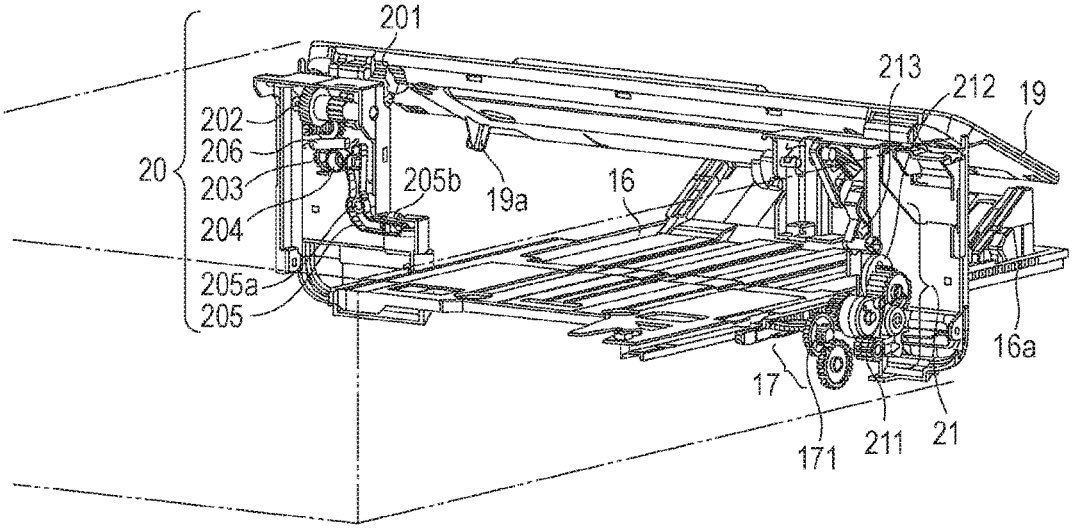
FIG. 3 is a perspective view of an ejection tray in a stacked state and an operation panel of the printing apparatus illustrated in FIG. 1.
Figure 4:
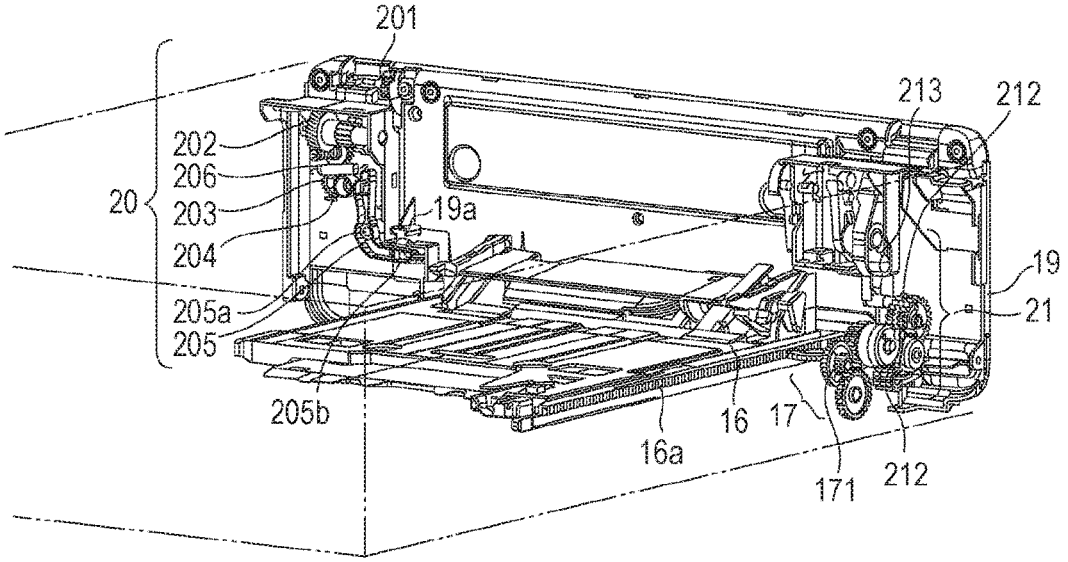
FIG. 4 is a perspective view of the ejection tray in a stored state and the operation panel of the printing apparatus illustrated in FIG. 1.

FIGS. 1 and 2 are external perspective views of a printing apparatus according to a first embodiment of the present disclosure. FIGS. 3 to 4 are perspective views illustrating configurations of an ejection tray and an operation panel, and are perspective views viewed from the inside of the apparatus body.

An ink jet printer that is an embodiment of the printing apparatus of the present disclosure is a serial type printing apparatus that performs printing by alternately performing a reciprocal motion of a printing head 2 and conveyance of a printing medium in a direction that intersects the direction of the reciprocal motion. Specifically, the printing apparatus includes a carriage 3 on which the printing head 2 is mounted. The carriage 3 is supported by a rail (not shown) in a reciprocally movable manner, and is reciprocally driven and controlled with a printing head driving belt 4 that is horizontally stretched behind the carriage 3, and a printing head driving motor 5. The members above constitute the printing head moving member (a moving member). A sheet conveying unit (a conveying member) including a sheet conveying roller 6, pinch rollers 7, a platen 8, a discharge roller 9, and a spur roller 10 is provided below a reciprocally moving area of the printing head 2. A conveyance motor belt 13 that transmits drive of a conveyance motor 12 is stretched across the conveyance roller two-stage pulley 11 at the left side end portion of the sheet conveying roller 6 in an integrated manner, such that forward and reverse rotational drive can be performed at will. Note that the left and the right herein are the left and the right when viewing the apparatus from the front (from the right side in FIG. 1). Furthermore, a discharge roller pulley 14 is also provided at the left side end portion of the discharge roller 9 in an integrated manner, and a discharge controller belt 15 is stretched across the discharge roller pulley 14 and the conveyance roller two-stage pulley 11, such that the sheet conveying roller 6 and the discharge roller 9 can be driven in a synchronized manner. Printing is performed on a sheet, which is conveyed by and pinched between the sheet conveying roller 6 and the pinch rollers 7, on the platen 8 with the printing head 2 in a band-like manner at a predetermined width (the width corresponding to the printable range of the printing head 2). The sheet (the printing medium) on which the above printing has been performed is pinched between the discharge roller 9 and the spur roller 10, and is conveyed until the unprinted portion opposes the printing head 2. As described above, alternation of a band-like printing at the predetermined width and the conveyance of the sheet is repeated, such that printing (image formation) on the entire sheet surface is performed. A driving direction in which the sheet is moved from the sheet conveying roller 6 towards the discharge roller 9 in the above manner is referred to as a forward driving direction (a forward rotation direction).

An ejection tray 16 is provided downstream of the discharge roller 9 in the forward driving direction. The ejection tray 16 stacks and holds the printed sheets discharged through the discharge roller 9. The ejection tray 16 is provided in an apparatus body 1 so as to be capable of being advanced and retracted. FIGS. 1 to 3 illustrate a stack position (a developed position) in which the ejection tray 16 is extended to a maximum degree, and FIG. 4 illustrates a contained position in which the ejection tray 16 is contained in the apparatus body 1. A driving rack unit 16*a* is provided on the left side end portion of the ejection tray 16 and is connected to tray driving gear train 17 at all times. The tray driving gear train 17 interlocked with the advancing and retracting movement of the ejection tray 16 rotates. A drive connection trigger unit 18 that is capable of transmitting or cutting off the driving force of the discharge roller 9 to and from the tray driving gear train 17 is provided at the left side end portion of the discharge roller 9. The members above constitute a portion of a drive connection member.

An operation panel 19 including a liquid crystal display and control buttons is disposed on the front side of the apparatus body 1. The upper portion of the operation panel 19 is pivotally supported in a swingable manner. The operation panel 19 can be swung between a retracted position (the contained position) that is in a vertical orientation illustrated in FIG. 4, and a horizontal position (the developed position). In the contained position illustrated in FIG. 4, the operation panel 19 covers and hides a discharge space of the printed sheet that is discharged through the discharge roller 9, such that the operation panel 19 is capable of reducing dust and foreign matter from entering inside the apparatus. The horizontal position of the operation panel 19 is a discharge position that opens the discharge space. A position maintaining mechanism 20 is provided on the right rear side of the operation panel 19. The position maintaining mechanism 20 includes a fan gear 201 provided in the operation panel 19 in an integrated manner, a speed increasing gear train 202, a swing gear 203, a final gear 204, a friction lever 205, and an urging spring 206. When a distal end of the operation panel 19 is moved downwards, the speed in which the position of the operation panel 19 changes is transmitted to the final gear 204 in an increased manner through the fan gear 201, the speed increasing gear train 202, and the swing gear 203. The friction lever 205 is provided so as to be swingable about a shaft 205*a*, an end portion of the friction lever 205 abuts against a cylindrical surface of the final gear 204, and the friction lever 205 is biased with the urging spring 206. With such a configuration, a predetermined load is applied to the final gear 204, such that the position of the operation panel 19 is maintained and, further, such that the distal end of the operation panel 19 is not moved down with a load created by the input operation of the user; accordingly, the distal end can be set to a downwards position only when a predetermined load or larger load is applied. Immediately before taking the position illustrated in FIG. 4, a lock portion 19*a* provided on a back surface of the operation panel 19 presses a latch portion 205*b* provided at the other end portion of the friction lever 205, such that while releasing the charged load, the operation panel 19 is slightly locked (temporarily locked) in the contained position. The above prevents a spring back of the operation panel 19 from happening. On the other hand, when the distal end of the operation panel 19 is moved upwards, since the swing gear 203 is swung and is separated from the final gear 204, the final gear 204 does not rotate and no load from the friction lever 205 is applied thereto.

FIGS. 1 to 3 illustrate the retracted position of the operation panel 19. The retracted position is a position in which the operation panel 19 is retracted from an area where the printed sheet discharged through the discharge roller 9 is discharged. A pushing and opening mechanism 21 of the operation panel is provided on the left behind the operation panel 19. In a case in which the operation panel 19 interlocked with the advancing and retracting movement of the ejection tray 16 is moved below the retracted position illustrated in FIGS. 1 to 3, operation panel 19 can be pushed and opened to the retracted position. In a case in which the operation panel 19 is moved above the retracted position, the operation panel 19 does not move even when the ejection tray 16 moves. The pushing and opening mechanism 21 of the operation panel swings a cam 212 with a gear train 211 connected to the tray driving gear train 17, and can push out a back of the operation panel 19 with a pushing lever mechanism 213.

Figure 5A:
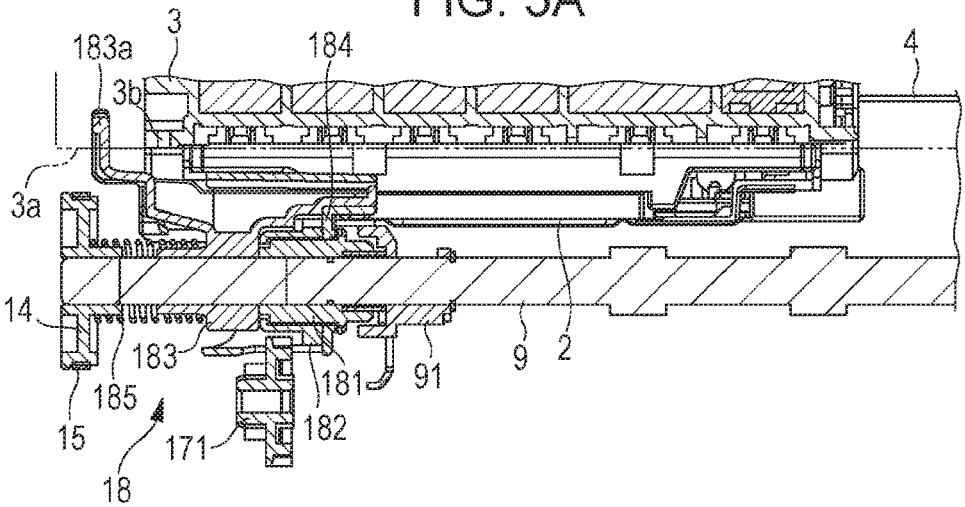
FIGS. 5A to 5C are cross-sectional views each illustrating a portion around a drive connection trigger unit of the printing apparatus illustrated in FIG. 1.
Figure 5B:
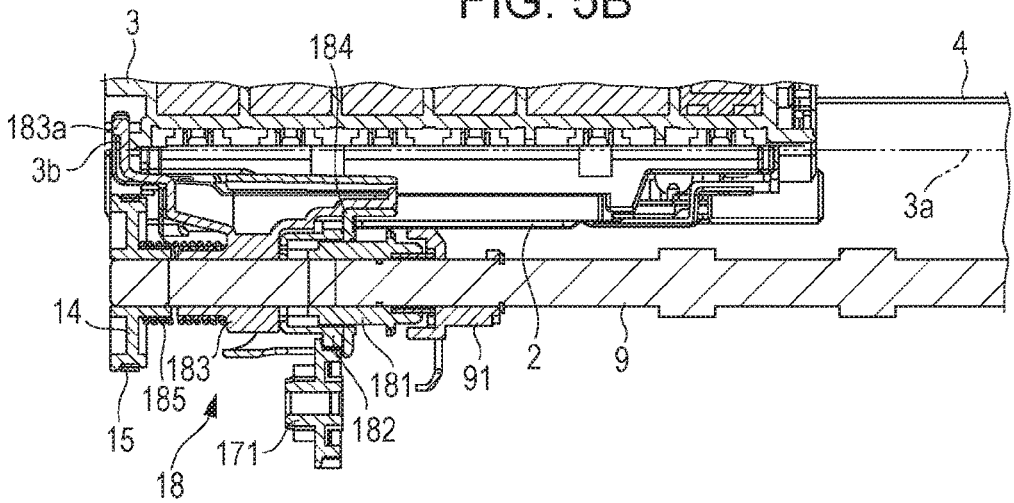
Figure 5C:
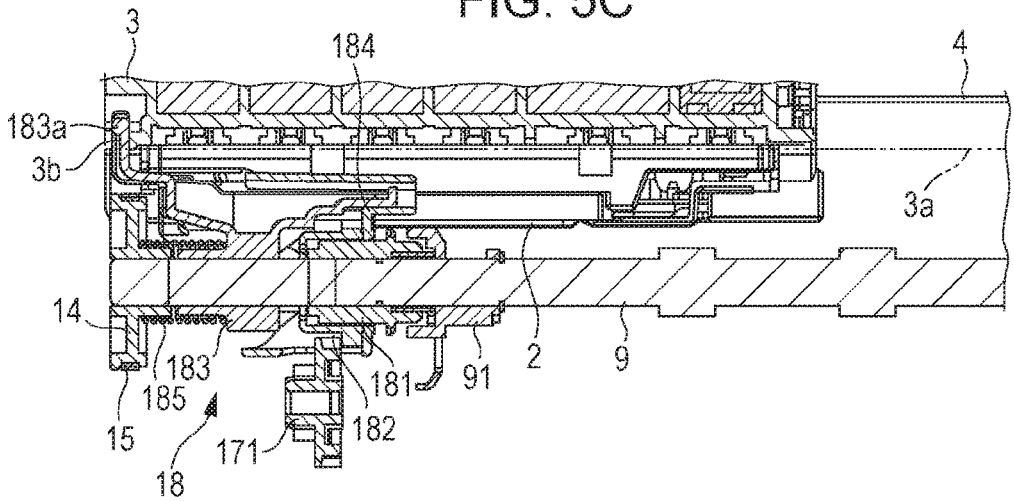
Figure 6A:
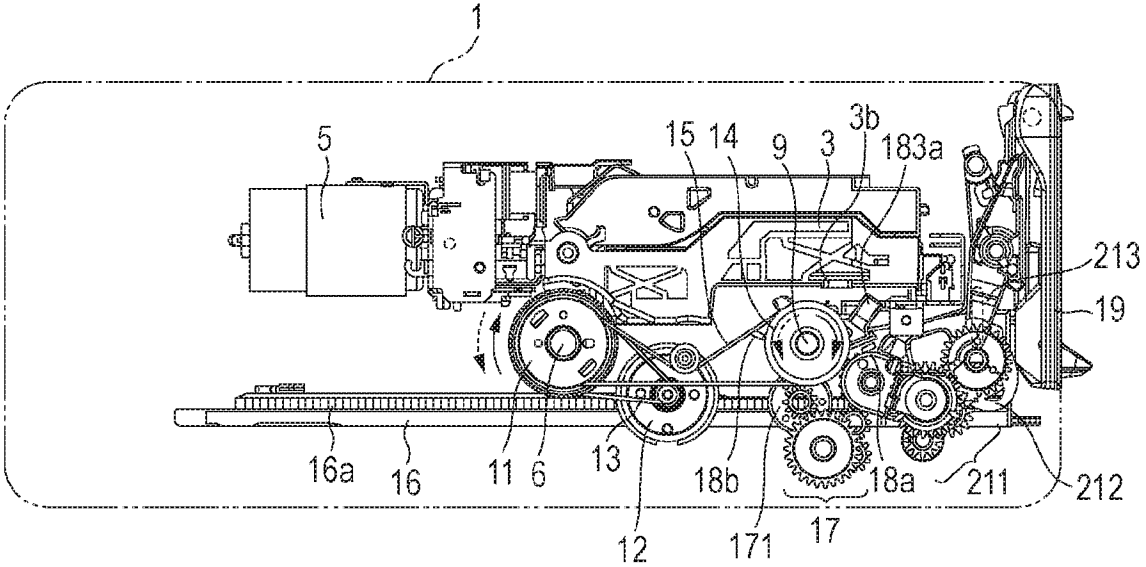
FIGS. 6A to 6D are explanatory drawings illustrating operations of the ejection tray and the operation panel of the printing apparatus illustrated in FIG. 1.
Figure 6B:
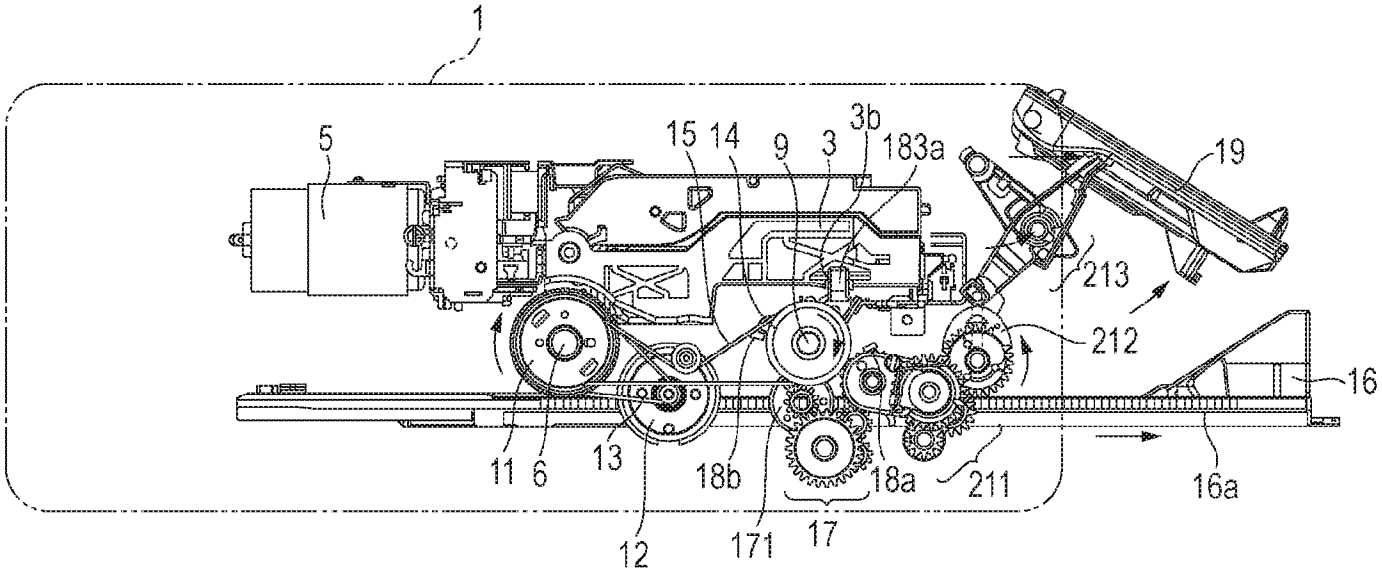
Figure 6C:
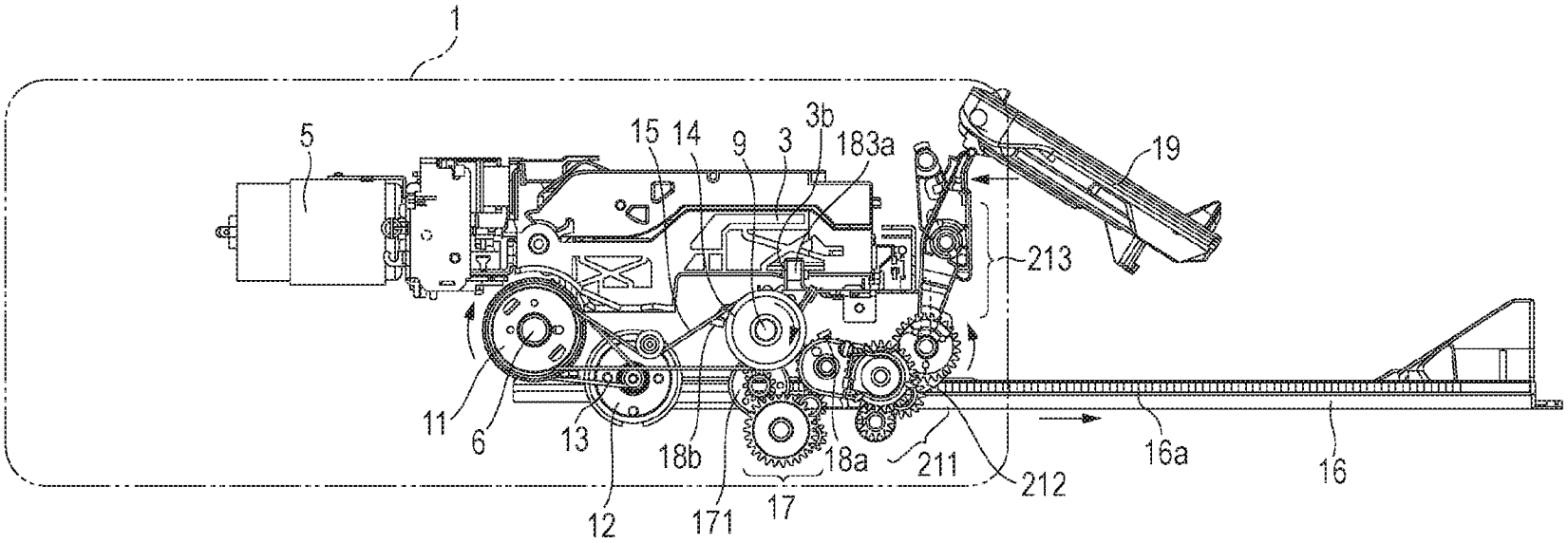
Figure 6D:
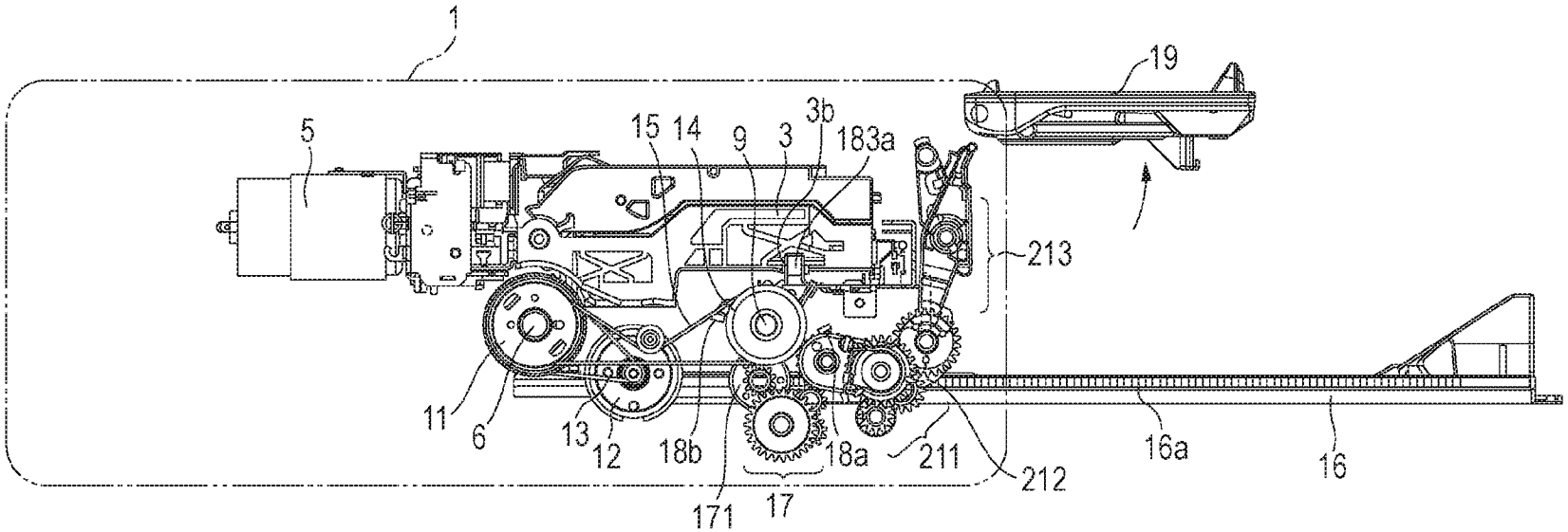

FIGS. 5A to 5C are cross-sectional views around the drive connection trigger unit 18 that is a portion of the drive connection member of the printing apparatus according to the first embodiment. A trigger gear base 181 is, in an integrated manner with the discharge roller 9, provided on the left side of a bearing 91 that pivotally supports the discharge roller 9. The trigger gear base 181 holds a trigger output gear 182 while, by being fitted to a key groove, restricting a movement of the trigger output gear 182 in the rotating direction and allowing a movement thereof in an axial direction. A trigger lever 183 and an auxiliary trigger lever 184 are rotatably supported by the discharge roller 9 so as to be movable in the axial direction. The movement of the trigger output gear 182 in the axial direction is restricted by the trigger lever 183 and the auxiliary trigger lever 184, and the trigger output gear 182 is biased and pinched by an urging spring (not shown) stretched between the trigger lever 183 and the auxiliary trigger lever 184. Furthermore, an urging spring 185 is disposed between the discharge roller pulley 14 on the left side of the discharge roller 9 and the trigger lever 183. The urging spring 185 biases the trigger lever 183 against an end face of the trigger gear base 181 such that the trigger lever 183 is in contact with end face of the trigger gear base 181. Turning force of the discharge roller 9 is, due to the friction between the above contact portions, is transmitted to the trigger lever 183 and the auxiliary trigger lever 184, such that the trigger lever 183 and the auxiliary trigger lever 184 are driven and rotated by the discharge roller 9. The driven rotation is restricted by trigger lever swing restriction portions 18*a* and 18*b* illustrated in FIGS. 1 to 2, and while in an abutted state, the frictional contact portions slide and maintain the positions of the trigger lever 183 and the auxiliary trigger lever 184.

As illustrated in FIGS. 5A to 5C, an arm portion (trigger arm) 183*a* is provided on the left side portion of the trigger lever 183. When the discharge roller 9 rotates in the forward direction, the frictional contact portions slide and maintains the position of the arm portion 183*a* in the retracted position, illustrated in FIGS. 1 and 2, in which the arm portion 183*a* is retracted from a moving area 3*a* of the carriage 3. Furthermore, when the discharge roller 9 rotates in the reverse direction, the frictional contact portions slide and maintains the position of the arm portion 183*a* in an enter position, illustrated in FIG. 5A, in which the arm portion 183*a* of the trigger lever 183 has entered the moving area 3*a* of the carriage 3. In a case in which the trigger lever 183 is in the enter position illustrated in FIG. 5A, when the carriage 3 moves from the right side of the moving area 3*a* to the left end portion, as illustrated in FIG. 5B, a groove portion 3*b* provided on the lateral side of the carriage 3 and the arm portion 183*a* of the trigger lever 183 are engaged with each other. Furthermore, the engagement restricts the trigger lever 183 from swinging and moves the trigger lever 183 to the left. Upon movement of the trigger lever 183, when the trigger output gear 182 moves to the left, the trigger output gear 182 and an input gear 171 that is the most upstream gear in the tray driving gear train 17 engages with each other, such that the drive connection trigger unit 18 is switched from a disconnected state to a connected state. In so doing, there is a case in which the phases of the trigger output gear 182 and the input gear 171 do not match each other. In such a case, as illustrated in FIG. 5C, in a state in which a left gear surface of the trigger output gear 182 and a right gear surface of the input gear 171 abut against each other, the urging spring (not shown) stretched between the trigger lever 183 and the auxiliary trigger lever 184 extends. Note that the left and right herein corresponds to the left and right in FIGS. 5A to 5C. Owing to the extension of the urging spring, the auxiliary trigger lever 184 presses the trigger output gear 182 to the left, and at the same time as the phase with the input gear 171 matches the rotation of the trigger output gear 182, the drive connection trigger unit 18 is switched to the connected state illustrated in FIG. 5B. In the connected state illustrated in FIG. 5B, since the groove portion 3*b* provided in the lateral side of the carriage 3 and the arm portion 183*a* of the trigger lever 183 are engaged with each other, the rotation of the input gear 171 is transmitted during both the forward and the reverse rotation of the discharge roller 9. Furthermore, when the discharge roller 9 is rotated in the forward direction, the ejection tray 16 becomes extended, and when the discharge roller 9 is rotated in the reverse direction, the ejection tray 16 is retracted.

When the discharge roller 9 is stopped and the carriage 3 is moved in the right direction as illustrated in FIG. 5A, the urging spring 185 pushes and moves the trigger lever 183 and the trigger output gear 182. With the above, the trigger lever 183 and the input gear 171 are separated from each other and the drive connection trigger unit 18 is switched from the connected state to the disconnected state. Furthermore, forward rotation of the discharge roller 9 in the disconnected state allows the arm portion 183*a* of the trigger lever 183 to retract from the moving area 3*a* of the carriage 3. Note that since the arm portion 183*a* retracts upon forward rotation of the discharge roller 9, the moving area 3*a* of the carriage 3 may coincide with the largest moving area of the carriage 3 needed when printing; accordingly, the reciprocally moving area of the carriage does not need to be increased for performing the drive connection operation. Furthermore, in the disconnected state, since the drive connection trigger unit 18 is spaced away from the drive of the conveyance motor 12, the advancing and retracting movement of the ejection tray 16 can be produced manually by the user.

FIGS. 6A to 6D are schematic diagrams illustrating operation of the ejection tray 16 and the operation panel 19 of the printing apparatus according to the first embodiment. In a standby state illustrated in FIG. 6A, the ejection tray 16 and the operation panel 19 are both in the contained position. Furthermore, the sheet conveying roller 6, the discharge roller 9, and the conveyance motor 12 rotate in the forward direction and the arm portion 183*a* of the drive connection trigger unit 18 is stopped at the retracted position that abuts against the trigger lever swing restriction portion 18*a*. The carriage 3 is positioned at the right end portion of the apparatus body 1, and the printing head 2 is capped with a maintenance mechanism (not shown). When a printing command is issued in the above standby state, the capping is canceled first such that the carriage 3 can be moved. Subsequently, the conveyance motor 12 is driven for a fixed amount or more in the reverse rotation direction, and the drive connection trigger unit 18 is driven and rotated, such that the drive connection trigger unit 18 is in the enter position, illustrated in FIG. 6B, abutting against the trigger lever swing restriction portion 18*b*. In such a state, the carriage 3 is moved to the left side end portion, the groove portion 3*b* of the carriage 3 and the arm portion 183*a* of the trigger lever 183 are engaged with each other such that the drive connection trigger unit 18 is transferred to the connected state. Subsequently, when the conveyance motor 12 is rotated in the forward direction, the drive of the discharge roller 9 is transmitted to the input gear 171 that is the gear most upstream in the tray driving gear train 17, and to the rack unit 16*a* of the ejection tray 16, such that the ejection tray 16 is extended. In so doing, the gear train 211 connected to the tray driving gear train 17 swings the cam 212, the pushing lever mechanism 213 pushes out the back of the operation panel 19, the operation panel 19 is set to the retracted position illustrated in FIG. 6B, and the operation panel 19 is maintained at the retracted position with the position maintaining mechanism 20. Furthermore, the conveyance motor 12 is rotated in the forward direction, and when a position detecting member (not shown) detects that the ejection tray 16 has reached the stack position illustrated in FIG. 6C, the conveyance motor 12 is stopped, the carriage 3 is returned to the right end portion of the apparatus body 1, and the drive connection trigger unit 18 is restored to the disconnected state. Furthermore, when a sheet is fed out with a sheet feeding member (not shown), the conveyance motor 12 is rotated in the forward direction, the sheet is conveyed until the leading edge of the sheet is immediately below the printing head 2, and the conveyance motor is stopped. Since the arm portion 183*a* of the drive connection trigger unit 18 is stopped in the retracted position that abuts against the trigger lever swing restriction portion 18*a*, the carriage 3 is capable of printing in a band-like manner at the predetermined width using the entire moving area 3*a*. The printing in a band-like manner at the predetermined width and the conveying of the sheet a predetermined length are repeated alternatively to complete printing on the entire surface. The printed sheet is discharged through the discharge roller 9 and is stacked and retained on the ejection tray 16. In so doing, the pushing lever mechanism 213 is contained once more, and the printed sheet discharged through the discharge roller 9 is stacked without coming into contact with the operation panel 19 while the position detecting member (not shown) monitors that the operation panel 19 has moved up above the retracted position illustrated in FIG. 6C. If the position detecting member detects that the operation panel 19 has moved down below the retracted position during the printing or while the sheet is discharged, the operation is stopped and a message urging the operation panel 19 to be moved up is displayed on the operation panel 19. The operation panel 19 can be moved up to a horizontal position illustrated in FIG. 6D, and the position thereof can be adjusted according to the position from where the operation panel 19 is viewed.

During a double-sided printing, at the time printing of one surface is completed, while the printed sheet is pinched between the discharge roller 9 and the spur roller 10, the conveyance motor 12 is rotated in the reverse direction, the sheet is drawn into a double-sided U-turn conveyance unit (not shown) behind the sheet conveying roller 6, and the front side and the back side are flipped (reversed) and the leading edge and the trailing edge are switched. At the time when the conveyance motor 12 is rotated in the reverse direction, since the carriage 3 is returned to the right end portion of the apparatus body 1, the drive connection trigger unit 18 maintains the disconnected state. When the flipped sheet enters between the sheet conveying roller 6 and the pinch rollers 7, the conveyance motor 12 is rotated in the forward direction and the sheet is pinched between the sheet conveying roller 6 and the pinch rollers 7 again, and printing is performed on the back side in a similar manner to the printing on the front side. Subsequently, the sheet on which double-sided printing has been performed is discharged and is stacked on the ejection tray.

In the present embodiment, if the position detecting member (not shown) detects that the ejection tray 16 is not contained when, for example, the power of the printing apparatus is off, the ejection tray 16 can be contained automatically. When detected that the ejection tray 16 is not contained, the capping is first cancelled so that the carriage 3 can be moved. Subsequently, the conveyance motor 12 is driven for a fixed amount in the reverse direction, and the drive connection trigger unit 18 is driven and rotated, such that the drive connection trigger unit 18 is in the enter position, illustrated in FIG. 6C, abutting against the trigger lever swing restriction portion 18*b*. In such a state, the carriage 3 is moved to the left side end portion, the groove portion 3*b* of the carriage 3 and the arm portion 183*a* of the trigger lever 183 are engaged with each other such that the drive connection trigger unit 18 is transferred to the connected state. Subsequently, when the conveyance motor 12 is rotated in the reverse direction, the drive of the discharge roller 9 is transmitted to the input gear 171 that is the gear most upstream in the tray driving gear train 17, and to the rack unit 16*a* of the ejection tray 16, such that the ejection tray 16 is retreated. In so doing, when the operation panel 19 has moved down below the retracted position, the cam 212 is swung with the gear train 211 connected to the tray driving gear train 17, and the pushing lever mechanism 213 pushes out the back of the operation panel 19. Furthermore, the operation panel 19 is set in the retracted position illustrated in FIG. 6B, and the retracted position is maintained with the position maintaining mechanism 20. Furthermore, the conveyance motor 12 is rotated in the reverse direction, and when the position detecting member (not shown) detects that the ejection tray 16 has reached the contained position illustrated in FIG. 6A, the conveyance motor 12 is stopped, the carriage 3 is returned to the right end portion of the apparatus body 1, and the drive connection trigger unit 18 is restored to the disconnected state.

In the above configuration, the movement of the ejection tray 16, which is an advancing and retracting module capable of being advanced and retracted with respect to the apparatus body 1, between the contained position and the stack position (developed position) is performed by using the driving force that conveys the sheet, which is a printing medium. Moreover, transmission of the driving force is performed when the trigger arm (the arm portion 183*a*) enters the moving area of the printing head and is pressed and moved by the moving member. Specifically, the drive connection trigger unit 18 transmits the drive of the conveyance motor 12 to the ejection tray 16 and the operation panel 19 when the combination of the operation of the reverse rotation of the conveyance motor 12 for a fixed amount and the movement of the carriage 3 to the left end portion has been achieved. Furthermore, the retraction of the carriage 3 can return the drive connection trigger unit 18 to the disconnected state. Accordingly, practically, the connected state and the disconnected state can be switched selectively. When disconnected, conveyance of the sheet, such as drawing the sheet for double-sided printing, can be performed without moving the ejection tray 16 and the operation panel 19, the driving force that conveys the sheet can be relatively easily used to drive the cap, and the like, and the ejection tray 16 and the operation panel 19 can be moved manually. In the connected state, the drive of the conveyance motor 12 in both the forward and reverse directions can be transmitted. Furthermore, selective switching between the connected state and the disconnected state, and the operation associated with the selective switching do not affect the normal printing operation, and a dedicated driving source and a dedicated driving and switching area are not needed; accordingly, reduction in cost and size can be achieved at the same time.

In other words, the drive connection member (the drive connection trigger unit 18, etc.) connects the conveying member and the advancing and retracting module to each other only when the movement of the conveying member (the discharge roller 9, etc.) in the direction opposite to the direction during printing, and the movement of the moving member (the printing head driving motor 5, etc.) work together. Accordingly, the connected state and the disconnected state can be selectively switched practically with the conveying member and the moving member. Furthermore, in the connected state, by switching the rotation of the conveying member between the rotation in the forward direction and the rotation in the reverse direction, the driving direction of the advancing and retracting module (the ejection tray 16, for example) is switched; accordingly, practically, the advancing and retracting operation thereof can be selectively switched. Moreover, the speed and the stop position of the advancing and retracting operation are controllable. The reciprocally moving area of the printing head 2 can be the moving area needed for printing, such that the reciprocally moving area does not have to be increased for the drive connection operation.

Second Embodiment

Figure 7:
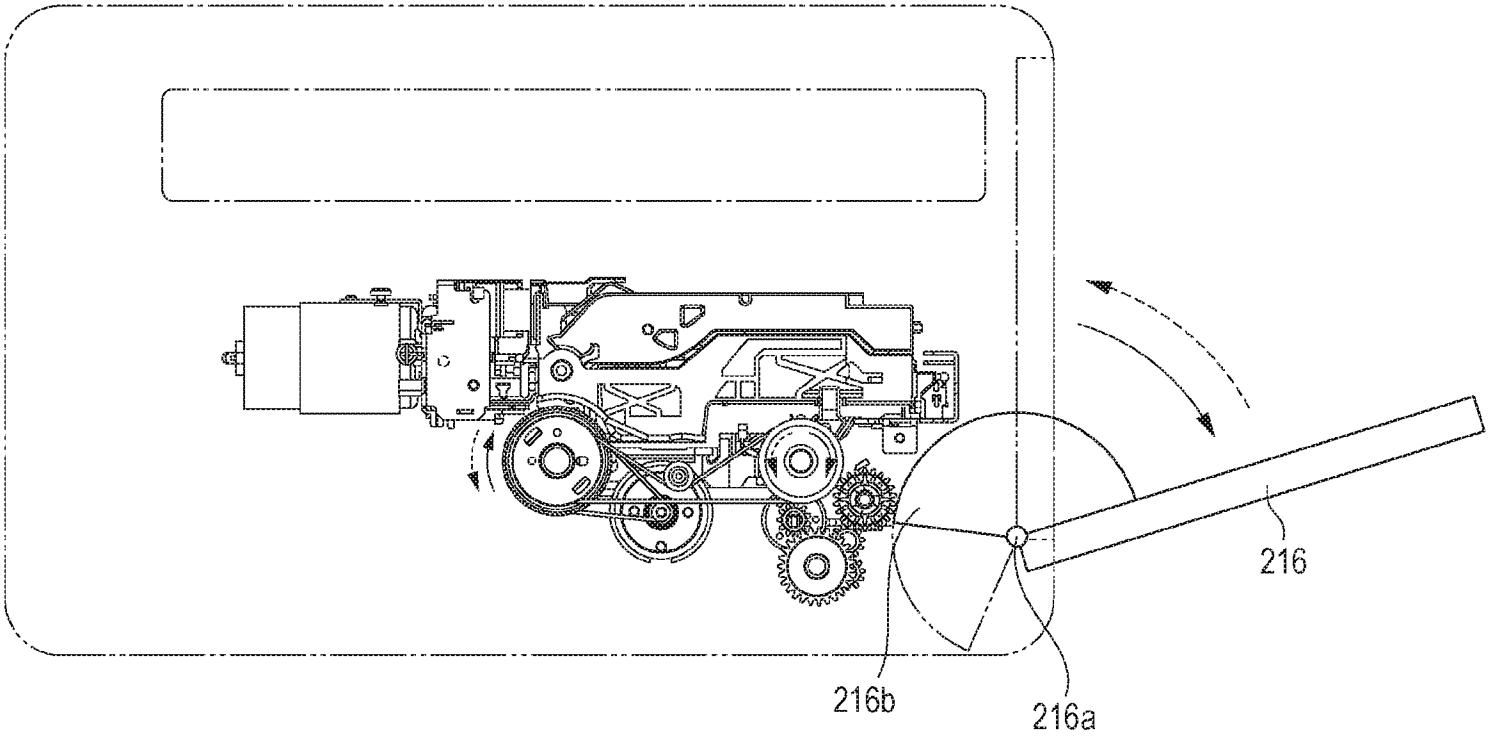
FIG. 7 is an explanatory drawing illustrating a portion of a printing apparatus of a second embodiment of the present disclosure.

FIG. 7 is a schematic diagram of a printing apparatus according to a second embodiment of the present disclosure. The printing apparatus according to the second embodiment employs, instead of the sliding and moving ejection tray 16 of the first embodiment, a swinging and opening/closing ejection tray 216. The ejection tray 216 disposed on the front side of the apparatus can be opened and closed about a shaft 216*a*. A fan gear 216*b* provided in an integrated manner with the ejection tray 216 is connected to a tray driving gear train 217. Since the drive connection trigger unit 18 and the input gear 171 have similar configurations to those of the first embodiment, description thereof is omitted. The ejection tray 216 is capable of swinging between a contained position illustrated with a two-dot chain line, and a stack position (a developed position) illustrated with a solid line. In the contained position, the position of the ejection tray 216 is maintained by a light load of a lock portion (not shown). In a case in which the drive connection trigger unit 18 is in the disconnected state, the ejection tray 216 can be opened and closed manually. In a case in which the drive connection trigger unit 18 is in the connected state, the opening and closing of the ejection tray 216 can be controlled with the driving of the conveyance motor 12 in both the forward and reverse directions and with a position detecting member (not shown).

With such a configuration, when opening the ejection tray 216 while the drive connection trigger unit 18 is in the connected state, since the conveyance motor 12 and the ejection tray 216 are connected even during the operation, the operation speed, the degree of deceleration in the operation speed, and the stop position can be controlled. Accordingly, a damper or the like to suppress the speed is not needed, and reduction in cost and size can be achieved at the same time.

Note that only either one of the ejection tray 16 and the operation panel 19 may be included in the advancing and retracting module of the present disclosure. In both cases, in the present disclosure, the advancing and retracting module can be selectively set to the connected state or to the disconnected state, and the effects described above can be obtained.

In the printing apparatus of the present disclosure, the conveyance accuracy of the printing medium is not reduced and the printing accuracy is not reduced, the operability is improved by controlling the advancement and retraction of the advancing and retracting module that can be contained during the non-printing period, and cost can be set low and space can be saved.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-149978 filed Jul. 29, 2016, which is hereby incorporated by reference herein in its entirety.

What is claimed is:

1. A printing apparatus comprising:

a printing head that performs printing on a printing medium;

a moving member that moves reciprocally with the printing head on the moving member;

a conveying member that conveys the printing medium in a conveying direction which intersects a moving direction of the printing head;

an advancing and retracting module that is contained in a contained position in a non-printing period, and that is developed in a developed position in a printing period; and a drive connection member that moves the advancing and retracting module between the contained position and the developed position with drive of the conveying member, wherein the drive connection member includes a trigger arm that enters a moving area of the printing head when the moving member is driven a predetermined amount in a direction opposite to a direction in which the printing medium is conveyed during the printing period, and wherein, in a state in which the moving member presses and moves the trigger arm that has entered the moving area of the printing head, the conveying member is connected to the advancing and retracting module such that a connected state in which transmission of the driving force is maintained.

2. The printing apparatus according to claim 1, wherein the drive connection member performs a connection operation, and wherein the connection operation transmits the driving force from the conveying member to the advancing and retracting module, inside the moving area of the printing head.

3. The printing apparatus according to claim 1, wherein the advancing and retracting module is an ejection tray that is capable of being moved between the contained position, in which the ejection tray is contained in an apparatus body, and the developed position, in which the printing medium that has been printed and discharged is stacked on the ejection tray.

4. The printing apparatus according to claim 3, wherein the ejection tray is capable of being manually moved when the drive connection member is in a disconnected state.

5. The printing apparatus according to claim 3, further comprising a detecting member that detects a position of the ejection tray, wherein, based on a detection result of the detecting member, a drive control is performed while the drive connection member is in the connected state.

6. The printing apparatus according to claim 3, wherein the advancing and retracting module includes the ejection tray, and an operation panel, and wherein the operation panel is capable of being moved between the contained position, in which the operation panel is contained in an apparatus body and that closes a discharge space of the printing medium on which printing has been performed, and the developed position in which the discharge space is open.

7. The printing apparatus according to claim 6, wherein the ejection tray is capable of being manually moved when the drive connection member is in the disconnected state, and wherein the operation panel is interlocked with the ejection tray when the drive connection member is either in the connected state or in the disconnected state.

8. The printing apparatus according to claim 6, further comprising a detecting member that detects a position of at least either one of the ejection tray and the operation panel, wherein, based on a detection result of the detecting member, a drive control is performed while the drive connection member is in the connected state.

9. The printing apparatus according to claim 1, wherein the advancing and retracting module is an operation panel that is capable of being moved between the contained position, in which the operation panel is contained in an apparatus body and that closes a discharge space of the printing medium on which printing has been performed, and the developed position in which the discharge space is open.

10. The printing apparatus according to claim 9, further comprising a detecting member that detects a position of the operation panel, wherein, based on a detection result of the detecting member, a drive control is performed while the drive connection member is in the connected state.

* * * * *